United States Patent [19]

Teraoka

[11] Patent Number: 4,851,690

[45] **Date of Patent: * Jul. 25, 1989**

[54] RADIATION IMAGE STORAGE PANEL

[75] Inventor: Masanori Teraoka, Kaisei, Japan

[73] Assignee: Fuji Photo Film Co., Ltd., Kaisei, Japan

[ * ] Notice: The portion of the term of this patent subsequent to Jun. 24, 2003 has been disclaimed.

[21] Appl. No.: 576,558

[22] Filed: Feb. 3, 1984

[30] Foreign Application Priority Data

Feb. 4, 1983 [JP] Japan ..... 58-16152

[51] Int. Cl.[4] ..... G03C 5/16

[52] U.S. Cl. ..... 250/484.1

[58] Field of Search ..... 250/337, 327.2, 484.1

[56] References Cited

U.S. PATENT DOCUMENTS 4,059,768 11/1977 Van Landeghom et al. ... 280/483.1
4,456,239 6/1984 Yamaguchi ..... 400/624
4,572,955 2/1986 Teraoka et al. ..... 250/483.1

*Primary Examiner*—Carolyn E. Fields
*Attorney, Agent, or Firm*—Gerald J. Ferguson, Jr.

[57] ABSTRACT

A radiation image storage panel comprising a support and a phosphor layer provided thereon which comprises a binder and a stimulable phosphor dispersed therein, characterized in that the support surface of said panel has a friction coefficient of not more than 0.6.

8 Claims, 2 Drawing Sheets

RADIATION IMAGE STORAGE PANEL

BACKGROUND OF THE INVENTION

1. FIELD OF THE INVENTION

The present invention is relates to a radiation image storage panel, and more particularly, to a radiation image storage panel improved in the resistance to physical deterioration such as abrasion.

2. DESCRIPTION OF THE PRIOR ART

For obtaining a radiation image, there has been conventionally employed a radiography utilizing a combination of a radiographic film having an emulsion layer containing a photosensitive silver salt material and an intensifying screen.

As a method replacing the above-described radiography, a radiation image recording and reproducing method utilizing a stimulable phosphor as described, for example, in U.S. Pat. No. 4,239,968, has been recently paid much attention. In the radiation image recording and reproducing method, a radiation image storage panel comprising a stimulable phosphor (i.e., a stimulable phosphor sheet) is employed, and the method involves steps of causing the stimulable phosphor of the panel to absorb a radiation energy having passed through an object or having radiated from an object; exciting the stimulable phosphor, or scanning the panel, with an electromagnetic wave such as visible light and infrared rays (hereinafter referred to as "stimulating rays") to sequentially release the radiation energy stored in the stimulable phosphor as light emission (stimulated emission); photoelectrically processing the emitted light to give electric signals; and reproducing a visible image from the electric signals.

Since the radiation image storage panel employed in the method hardly deteriorates upon exposure to a radiation and stimulating rays, the panel can be employed repeatedly for a long period. In practical use, after scanning the panel with stimulating rays to release radiation energy as stimulated emission therefrom (otherwise, in advance of next use of the panel), light in the wavelength region of stimulating rays for the phosphor or heat is usually applied to the panel so as to erase the radiation energy stored in the panel, because the stored radiation energy cannot be fully released from the panel by scanning with the stimulating rays.

In the above-described radiation image recording and reproducing method, a radiation image can be obtained with a sufficient amount of information by applying a radiation to the object at considerably smaller dose, as compared with the case of using the conventional radiography. Accordingly, this radiation image recording and reproducing method is of great value especially when the method is used for medical diagnosis.

The radiation image storage panel employed in the radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock. Furthermore, the edge faces of the panel may be reinforced by coating them with a polymer material to enhance the mechanical strength, as described in Japanese Patent Provisional Publication No. 58(1983)-68746 (corresponding to U.S. patent application Ser. No. 434,885, now U.S. Pat. No. 4,510,388, and European Patent Publication No. 83470).

As described above, the radiation image storage panel is employed repeatedly in a cyclic procedure comprising steps of erasing the remaining energy from the panel, exposing the panel to a radiation, and scanning the panel with stimulating rays (that is, reading out the radiation image as stimulated emission from the panel). In the above-mentioned cyclic procedure, the panel is transferred from a step to the subsequent step through a certain transfer system and generally piled on other panels to store after one cycle is finished.

Accordingly, the radiation image storage panel employed in the radiation image recording and reproducing method is subjected to conditions quite different from those to which the intensifying screen is subjected in the conventional radiography wherein the screen is fixed in a cassette. For this reason, various troubles which never occur in the use of the conventional intensifying screen are encouraged in the use of the radiation image storage panel.

For instance, both surfaces of the radiation image storage panel are sometimes damaged by physical contact such as rubbing of a surface (the phosphor layer-side surface) of the panel against a surface (the support surface) of another panel, or rubbing of a surface of the panel against an edge of another panel, when the panel is piled on the other panel or moved from the pile of panels to the transfer system in the repetitious use comprising transfering and piling of the panel. Particularly, the physical damage occurring on the phosphor layer-side surface is liable to cause scattering of stimulating rays, which results in decrease of an amount of image information to be obtained as well as obscuration of the image information. Such image information gives a visible image of extremely poor image quality.

Accordingly, there is desired such a radiation image storage panel having a basic structure comprising a support and a phosphor layer provided thereon as hardly suffers damage on both surfaces thereof, especially on the phosphor layer-side surface thereof.

SUMMARY OF THE INVENTION

Accordingly, an object of the present invention is to provide a radiation image storage panel improved in the resistance to physical deterioration such as abrasion.

The above-described object is accomplished by a radiation image storage panel of the present invention comprising a support and a phosphor layer provided thereon which comprises a binder and a stimulable phosphor dispersed therein, characterized in that the support surface of said panel has a friction coefficient of not more than 0.6.

In the present specification, the term "support surface" of the panel means a free surface (surface not facing the phosphor layer) of the support, and the term "phosphor layer-side surface" of the panel means a free surface (surface not facing the support) of the phosphor layer or a free surface of an additional layer optionally provided on the phosphor layer such as a protective film.

The term "friction coefficient" as used herein means a kinetic friction coefficient which represents an amount of kinetic friction given to an object moving at a certain rate, and is determined by the following method.

The radiation image storage panel is cut to give a square test strip (2 cm×2 cm), and the test strip is placed on a polyethylene terephthalate sheet in such a manner that the support surface of the panel faces the polyethylene terephthalate sheet. A weight is placed on the test strip to apply a total weight of 100 g. onto the face of the polyethylene terephthalate sheet. Then, the test strip having the weight thereon is pulled at a rate of 4 cm/min. by means of a tensile testing machine (Tensilon UTM-11-20, trade name, manufactured by Toyo Baldwin Co., Ltd., Japan) under the conditions of a temperature of 25° C. and a humidity of 60%, to measure a tensile force F (g.) of the test strip moving at a rate of 4 cm/min. From the measured tensile force F and the applied weight (100 g.), the friction coefficient is determined as a value of (tensile force)/(applied weight).

DETAILED DESCRIPTION OF THE INVENTION

Figure 1:
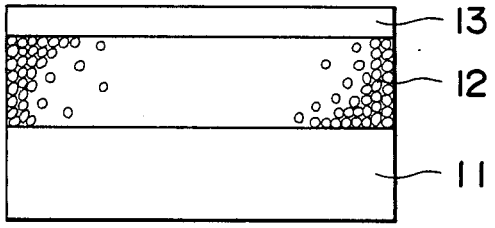
FIG. 1 schematically illustrates an embodiment of the radiation image storage panel of the invention in which the support thereof is made of material having a kinetic friction coefficient of not more than 0.6, FIG. 2 schematically illustrates another embodiment of the radiation image storage panel of the invention having a support in the form of a sheet that has on the exposed side a surface having been lowered in a kinetic friction coefficient by physical or chemical surface-roughing processing, and FIG. 3 schematically illustrates an embodiment of the radiation image storage panel of the invention having chamfered edges.

The radiation image storage panel of the invention can have a structure as illustrated in FIG. 1, which comprises a support 11 made of material as such having a kinetic friction coefficient of not more than 0.6, a phosphor layer 12, and a protective layer 13.

Figure 2:
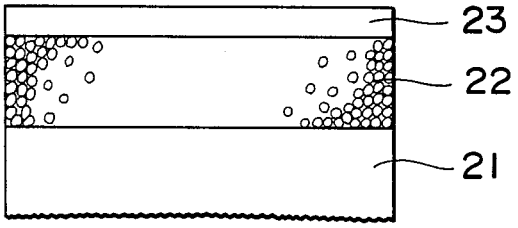

The radiation image storage panel of the invention also can have a structure as illustrated in FIG. 2, which comprises a support 21 in the form of a sheet that has on the exposed side (lower side thereof in FIG. 2) a surface having been lowered in a kinetic friction coefficient to a value of not more than 0.6 by physical or chemical surface-roughing processing, a phosphor layer 22, and a protective layer 23.

The radiation image storage panel of the present invention is improved in the resistance to physical deterioration by employing a support having a surface whose friction coefficient is not more than 0.6. The employment of such support for the panel can effectively prevent the panel from damage such as abrasion which is liable to be given onto the phosphor layer-side surface of the panel through physical contact of said panel with another panel. The physical contact is encountered when the panel is piled on another panel or transferred from the piled position, and is for instance, rubbing of the surface of the panel against a surface of another panel. Accordingly, in the case that the radiation image storage panel of the present invention is used, a radiation image having higher quality can be obtained than the case using the conventional panel whose support surface has a friction coefficient of more than 0.6.

The radiation image storage panel of the present invention having the above-described preferable characteristics can be prepared, for instance, in a manner described below.

The support material employed in the present invention can be selected from sheets made of materials having a small friction coefficient or sheets having surfaces whose friction coefficient has been lowered by a physical or chemical processing. A representative example of the material having a small friction coefficient is a polyfluoroethylene film such as a Teflon film. Examples of the sheet having a surface whose friction coefficient has been lowered by a physical or chemical processing include plastic films such as a polyethylene terephthalate film, a polyolefin film (e.g. a polyethylene film, a polypropylene film or the like), cellulose acetate film, polyester film, polyamide film, polyimide film, cellulose triacetate film and polycarbonate film, having been subjected to a surface-roughing processing. The above-described materials are given by no means to restrict the material employable for the support in the present invention. Any other materials can be also employed, provided that the material has a small friction coefficient on its surface.

From a viewpoint of reliable resistance to the physical deterioration of the surfaces of radiation image storage panel and characteristics of the panel as an information recording material, a plastic film having been subjected to a surface-roughing processing is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the present invention, the surface of the support (which is to serve as one surface of panel) made of the above-described material is required to have a friction coefficient of not more than 0.6, and preferably of not more than 0.5.

In the preparation of the conventional radiation image storage panel, one or more additional layers are occasionally provided between the support and the phosphor layer, so as to enhance the bonding force between the support and the phosphor layer, or to improve the sensitivity of the panel or the quality of an image provided thereby. For instance, a subbing layer or an adhesive layer may be provided by coating a polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support.

As described in Japanese Patent Application No. 57(1982)-82431 (which corresponds to U.S. patent application Ser. No. 496,278, now U.S. Pat. No. 4,575,635, and the content of which is described in European Patent Publication No. 92241), the phosphor layer-side surface of the support (or the surface of an adhesive layer, light-reflecting layer, or light-absorbing layer in the case where such layers provided on the phosphor layer) may be provided with protruded and depressed portions for enhancement in the sharpness of an image provided by the resulting radiation image storage panel.

Onto the support, a phosphor layer is provided. The phosphor layer may be a single layer or a plurality of the same or different layers superposed one on another.

The phosphor layer comprises a binder and phosphor particles dispersed therein.

The stimulable phosphor particles, as described hereinbefore, give stimulated emission when excited by stimulating rays after exposure to a radiation. In the viewpoint of practical use, the stimulable phosphor is desired to give stimulated emission in the wavelength region of 300–500 nm when excited by stimulating rays in the wavelength region of 400–850 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO \cdot xAl_2O_3$:Eu, in which x is a number satisfying the condition of $0.8 \leqq x \leqq 10$, and $M^{2+}O \cdot xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,236,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078; and $(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145 (corresponding to U.S. Pat. No. 4,239,968).

The above-described stimulable phosphors are given by no means to restrict the stimulable phosphor employable in the present invention. Any other phosphor can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copolymer, polyurethane, cellulose acetate butyrate, polyvinyl alcohol, and linear polyester. Particularly preferred are nitrocellulose, linear polyester, and a mixture of nitrocellulose and linear polyester.

The phosphor layer can be formed on the support, for instance, by the following procedure.

In the first place, phosphor particles and a binder are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:40.

The coating dispersion may contain a dispersing agent to increase the dispersibility of the phosphor particles therein, and also contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly to the surface of the support to form a layer of the coating dispersion. The coating procedure can be carried out by a conventional method such as a method using a doctor blade, a roll coater or a knife coater.

After applying the coating dispersion to the support, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within a range of from 20 μm to 1 mm, preferably from 50 to 500 μm.

The phosphor layer can be provided on the support by the methods other than that given in the above. For instance, the phosphor layer is initially prepared on a sheet (false support) such as a glass plate, metal plate or plastic sheet using the aforementioned coating dispersion and then thus prepared phosphor layer is overlaid on the genuine support by pressing or using an adhesive agent.

The radiation image storage panel generally has a transparent film on a free surface of a phosphor layer to protect the phosphor layer from physical and chemical deterioration. In the panel of the present invention, it is preferable to provide a transparent film for the same purpose.

The transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within a range of approx. 3 to 20 μm.

For further improvement in the transferability and the resistance to physical deterioration such as abrasion of the radiation image storage panel, the panel of the present invention is preferably chamfered on the edges thereof and then covered on the edge faces thereof including the chamfered edge with a polymer material. The chamfering and covering can be carried out in the manner as described in Japanese Patent Application No. 57(1982)-87799 (corresponding to U.S. patent application Ser. No. 496,731, now U.S. Pat. No. 4,511,802, and European Patent Application No. 83105137.0).

Figure 3:
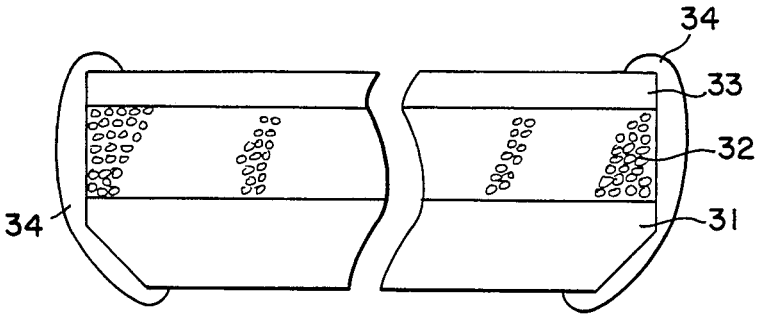

The radiation image storage panel of the invention having chamfered edges is illustrated in FIG. 3, in which the panel comprises a support 31 made of material as such having a friction coefficient of not more than 0.6 and being chamfered at both sides, a phosphor layer 32, and a protective layer 33. The both sides can be covered on the edge with a polymer material 34.

The chamfering is preferably applied to the front edge (viewed along the forwarding direction) of the panel on the support side for facilitating transfer of the panel. It is more preferable to chamfer all edges of the panel on the support side for more completely preventing the surface of the panel from damage. Furthermore, it is preferable to chamfer the edges on the phosphor layer side as well as on the support side, so as to further improve both the easiness for transferring the panel and the resistance to physical deterioration of the panel. The so chamfered edge may have a flat face or a curved face.

The chamfering of the edge on the support side of the panel should be preferably done in a depth within the range of 1/50 to 1/1 against the thickness of the support, measured in the direction vertical to the panel. Likewise, the chamfering of the edge on the phosphor layer side of the panel should be preferably done in a depth within the range of 1/50 to 1/1 against the thickness of the phosphor layer. When an edge on the support side and an edge on the phosphor layer side opposite to said edge on the support side are to be chamfered, the depth of at least one chamfered space is preferably adjusted to a level of less than 1/1 (against the same as above) so that the edge chamfered on both sides might not form a sharp edge.

The radiation image storage panel chamfered as described above may be covered with a polymer material on its edge faces to reinforce the chamfered face.

The materials employable for covering the edge faces can be chosen from those generally known as polymer materials. For instance, there can be mentioned the following polyurethane and acrylic resins which are described in the aforementioned Japanese Patent Provisional Publication No. 58(1983)-68746.

Preferred polyurethane is a polymer having urethane groups —NH—COO— in the molecular chain. Examples of such polyurethane include a polyaddition reaction product of 4,4'-diphenylmethane diisocyanate with 2,2'-diethyl-1,3-propanediol, a polyaddition reaction product of hexamethylene diisocyanate with 2-n-butyl-2-ethyl-1,3-propanediol, a polyaddition reaction product of 4,4'-diphenylmethane diisocyanate with bisphenol A, and a polyaddition reaction product of hexamethylene diisocyanate with resorcinol.

Examples of the acrylic resin include homopolymers of acrylic acid, methyl acrylate, ethyl acrylate, butyl acrylate, methylacrylic acid and methylmethacrylic acid; and copolymers of these monomers with other monomers such as an acrylic acid-styrene copolymer and an acrylic acid-methyl methacrylate copolymer. Particularly preferred material is poly(methyl methacrylate), namely, a homopolymer of methyl methacrylate, and it is preferred to employ an acrylic resin having a polymerization degree ranging from $1\times10^4$ to $5\times10^5$.

Further, a mixture of the above-described polyurethane or acrylic resins (especially acrylic resins) with other various polymer materials (polymers for blending) can be also employed for edge-reinforcing of the edge faces of panel. Most preferred polymer for blending is a vinyl chloride-vinyl acetate copolymer. A representative example of the blended resin is a mixture of an acrylic resin and a vinyl chloride-vinyl acetate copolymer in a ratio of 1:1 to 4:1 by weight, the latter containing vinyl chloride in a ratio of 70–90% and having a polymerization degree of 400–800.

The present invention will be illustrated by the following examples, but these examples by no means restrict the invention.

Example 1

A polyethylene terephthalate film (support, thickness: 250 μm) was subjected to sand blasting, to provide a rough surface with a great number of pits having a mean depth of 2 μm, a maximum depth of 7 μm and a mean diameter at the opening of 20 μm.

Independently, to a mixture of an europium activated barium fluorobromide stimulable phosphor ($BaFBr:Eu^{2+}$) and a linear polyester resin were added successively methyl ethyl ketone and nitrocelluose (nitrification degree: 11.5%), to prepare a dispersion containing the phosphor particles. Subsequently, tricresyl phosphate, n-butanol and methyl ethyl ketone were added to the resulting dispersion. The mixture was sufficiently stirred by means of a propeller agitater to obtain a homogeneous coating dispersion having a viscosity of 25–35 PS (at 25° C.).

The coating dispersion was applied to the surface-roughed support placed horizontally on a glass plate in such a manner that the rough surface thereof is in contact with the glass plate. The application of the coating dispersion was carried out using a doctor blade. The support having a layer of the coating dispersion was then placed in an oven and heated at a temperature gradually rising from 25° to 100° C. Thus, a phosphor layer having thickness of 300 μm was formed on the support.

On the phosphor layer was placed a polyethylene terephthalate transparent film (thickness: 12 μm; provided with a polyester adhesive layer on one surface) to combine the film and the phosphor layer with the adhesive layer, to form a transparent protective film thereon.

Thus, a radiation image storage panel consisting essentially of a support, a phosphor layer and a protective film was prepared.

Example 2

The same polyethylene terephthalate film as employed in Example 1 was subjected to sand blasting, to provide a rough surface with a great number of pits having a mean depth of 0.2 μm, a maximum depth of 0.8 μm and a mean diameter at the opening of 0.5 μm.

The radiation image storage panel consisting essentially of a support, a phosphor layer and a protective film was then prepared in the same manner as described in Example 1, except that the above rough-surfaced polyethylene terephthalate film was employed as the support.

Comparison Example 1

The radiation image storage panel consisting essentially of a support, a phosphor layer and a protective film was prepared in the same manner as described in Example 1, except that the polyethylene terephthalate film not having been subjected to sand blasting was employed as the support.

The so prepared radiation image storage panels were measured on the friction coefficient of the support surface thereof by the method described hereinbefore and recited below.

The radiation image storage panel was cut to give a square test strip (2 cm×2 cm), and the test strip was placed on a polyethylene terephthalate sheet in such a manner that the support faced the polyethylene terephthalate sheet. A weight was placed on the test strip to apply a total weight of 100 g. onto the face of the polyethylene terephthalate sheet. Then, the test strip having the weight thereon was pulled at a rate of 4 cm/min. by means of a tensile testing machine (Tensilon UTM-11-20, trade name, manufactured by Toyo Baldwin Co., Ltd., Japan) under the conditions of a temperature of 25° C. and a humidity of 60%, to measure a tensile force F (g.) of the test strip moving at a rate of 4 cm/min. From the measured tensile force F and the applied weight (100 g.), the friction coefficient was determined as a value of (tensile force)/(applied weight).

Then, the radiation image storage panels were evaluated on the resistance to physical deterioration (abrasive damage) by observing abrasion produced under the rubbing procedure described below.

The radiation image storage panel was cut to give a rectangular test strip (25.2 cm×30.3 cm), and the test strip was placed on a sheet made of the same material as employed for the support surface of the panel (namely, the same polyethylene terephthalate film (sheet) as in the present examples) in such a manner that the support of the test strip faced the sheet. The test strip was then rubbed against the sheet 1000 times along a rubbing path of 10 cm. After the rubbing was complete, the surface of the polyethylene terephthalate sheet was evaluated on abrasion visually.

The results of the evaluation on the resistance to abrasive damage of the radiation image storage panels are marked by the following three levels of A, B and C.

A: Abrasion was hardly observed.

B: A little abrasion was observed, but the abrasion was such a low level that no problem was brought about to the panel in practical use.

C: Abrasion was apparently noted.

The results are set forth in Table 1.

TABLE 1

| | Friction Coefficient | Resistance to Abrasion |
|---|---|---|
| Example 1 | 0.43 | A |
| Example 2 | 0.49 | B |
| Com. Example 1 | 0.67 | C |

I claim:

1. A radiation image storage panel comprising a support and a phosphor layer provided thereon which comprises a binder and a stimulable phosphor dispersed therein, characterized in that the support surface of said panel has a kinetic friction coefficient on polyethylene terephthalate sheet of not more than 0.6, at least one edge of the support side of the panel being chamfered, with edge faces including the chamfered edge being covered with a polymer material.

2. A radiation image storage panel as claimed in claim 1, in which the friction coefficient of the support surface is not more than 0.5.

3. The radiation image storage panel as claimed in claim 1, in which the support is made of a plastic film.

4. The radiation image storage panel as claimed in claim 1, in which the support is made of a polyfluoroethylene film.

5. The radiation image storage panel as claimed in claim 1 in which the support is a plastic film support that has on its exposed side a roughened surface having a kinetic friction coefficient value of not more than 0.6, said kinetic friction coefficient value being determined against the polyethylene terephthalate sheet.

6. In a radiation image storage panel comprising a support and a phosphor layer provided on one side of the support which comprises a binder and a stimulable phosphor dispersed therein, the improvement in which said support is a plastic film support that has on its exposed side a roughened surface having a kinetic friction coefficient value of not more than 0.6, said kinetic friction coefficient value being determined against a polyethylene terephthalate sheet.

7. The radiation image storage panel as claimed in claim 6, in which the kinetic friction coefficient of the surface on the exposed side of the support is not more than 0.5.

8. The radiation image storage panel as claimed in claim 6, in which the plastic film support is made of polyethylene terephtalate.

* * * * *